US010204756B2

(12) United States Patent
Sasaki et al.

(10) Patent No.: US 10,204,756 B2
(45) Date of Patent: Feb. 12, 2019

(54) COIL TERMINAL AND ELECTROMAGNETIC RELAY PROVIDED THEREWITH

(71) Applicant: OMRON Corporation, Kyoto-shi, Kyoto (JP)

(72) Inventors: Jun Sasaki, Kumamoto (JP); Kazuhiro Tsutsui, Kumamoto (JP)

(73) Assignee: OMRON Corporation, Kyoto-shi (JP)

( * ) Notice: Subject to any disclaimer, the term of this patent is extended or adjusted under 35 U.S.C. 154(b) by 2 days.

(21) Appl. No.: 15/552,702

(22) PCT Filed: Mar. 3, 2016

(86) PCT No.: PCT/JP2016/056631
§ 371 (c)(1),
(2) Date: Aug. 22, 2017

(87) PCT Pub. No.: WO2016/152444
PCT Pub. Date: Sep. 29, 2016

(65) Prior Publication Data

US 2018/0047537 A1 Feb. 15, 2018

(30) Foreign Application Priority Data

Mar. 26, 2015 (JP) ..... 2015-064755

(51) Int. Cl.
*H01H 50/44* (2006.01)

(52) U.S. Cl.
CPC ..... *H01H 50/443* (2013.01); *H01H 2050/446* (2013.01)

(58) Field of Classification Search
CPC ..... H01H 50/443; H01H 2050/446
See application file for complete search history.

(56) References Cited

U.S. PATENT DOCUMENTS 4,232,281 A * 11/1980 Smith ..... H01H 50/44 29/622
4,424,501 A * 1/1984 Goodrich ..... H01H 50/443 335/135
4,475,095 A * 10/1984 Brown ..... H01H 50/60 335/131

(Continued)

FOREIGN PATENT DOCUMENTS

CN 201629267 U 11/2010
CN 201689833 U 12/2010

(Continued)

OTHER PUBLICATIONS

English translation of Written Opinion of PCT/JP2016/056631 dated May 24, 2016 from the International Searching Authority.

(Continued)

*Primary Examiner* — Mohamad Musleh
(74) *Attorney, Agent, or Firm* — Metrolexis Law Group, PLLC

(57) ABSTRACT

A coil terminal includes: first to third terminal portions configured to supply a current to a coil; a coupler configured to couple these first to third terminal portions; and connectors provided in the coupler and connected with a lead wire of the coil. The coupler is formed by a resistive material, and includes a resistance regulator formed by bending at least part of the coupler.

6 Claims, 8 Drawing Sheets

(56) References Cited

U.S. PATENT DOCUMENTS

| | | | | | |
|---|---|---|---|---|---|
| 5,132,653 | A * | 7/1992 | Nakatake | H01H 51/065 | 200/293 |
| 5,270,674 | A * | 12/1993 | Nakanishi | H01H 50/026 | 335/78 |
| 5,517,167 | A * | 5/1996 | Yamamoto | H01F 5/04 | 335/132 |
| 5,535,083 | A * | 7/1996 | Sako | H01H 50/021 | 335/132 |
| 2015/0262743 | A1* | 9/2015 | Mimura | H01F 5/04 | 335/299 |
| 2018/0047537 | A1* | 2/2018 | Sasaki | H01H 50/443 | |

FOREIGN PATENT DOCUMENTS

| | | | | | |
|---|---|---|---|---|---|
| CN | 102623247 | A | | 8/2012 | |
| CN | 102956405 | A | | 3/2013 | |
| JP | 55071005 | A | * | 5/1980 | H01H 50/443 |
| JP | 2000-11838 | A | | 1/2000 | |
| JP | 2007-207495 | A | | 8/2007 | |
| JP | 2008-234952 | A | | 10/2008 | |
| JP | 2010-062078 | A | | 3/2010 | |

OTHER PUBLICATIONS

Office action dated Aug. 2, 2018 in a counterpart Chinese patent application.

International Search Report of PCT/JP2016/056631 dated May 24, 2016.

* cited by examiner

COIL TERMINAL AND ELECTROMAGNETIC RELAY PROVIDED THEREWITH

TECHNICAL FIELD

The present invention relates to a coil terminal and an electromagnetic relay provided therewith.

BACKGROUND ART

As an electromagnetic relay, there has been one described in Patent Document 1, for example. This electromagnetic relay is provided with: an electromagnetic device including an electric magnet that is excited by electric conduction, and a pair of coil terminals for allowing a current to flow in this electric magnet; and a contact mechanism that brings a fixed contact and a movable contact into contact with each other or separate those contacts from each other in association with excitation or demagnetization of the electric magnet.

PRIOR ART DOCUMENT

Patent Document

Patent Document 1: Japanese Unexamined Patent Publication No. 2000-11838

SUMMARY OF THE INVENTION

Problems to be Solved by the Invention

However, the above conventional electromagnetic relay is provided with a ready-made resistor for absorbing a surge voltage generated from the electromagnetic device, for example. This has limited the shape and placement of the coil terminal, making it difficult to deal with a design change, such as size reduction, desired by the user.

In view of the foregoing problem, it is an object of the present invention to provide a coil terminal with a large design freedom, and an electromagnetic relay provided with this coil terminal.

Means for Solving the Problem

In order to solve the above problem, a coil terminal of the present invention includes: at least two terminal portions configured to supply a current to a coil; a coupler configured to couple at least the terminal portions; and at least two connectors provided in the terminal portions or the coupler and connected with a lead wire of the coil. The coupler is formed by a resistive material, and includes a resistance regulator formed by bending at least part of the coupler.

Effect of the Invention

According to the coil terminal of the present invention, the coupler configured to couple at least the terminal portions is formed by the resistive material, and the resistance regulator formed by bending at least part of the coupler is provided. Thus, changing the kind of the resistive material and the shape of the resistance regulator can adjust resistance between the terminal portions. It is therefore possible to set a value of resistance between the terminal portions to a desired value without restrictions on the shape and placement which would occur at the time of mounting a ready-made resistor or the like. This can result in facilitating reduction in size of the electromagnetic relay, for example.

As one embodiment of the present invention, it may be configured such that the terminal portions, the coupler, the connectors, and the resistance regulator are disposed along the same plane, the terminal portions and the resistance regulator project in the same direction, and the connectors and the resistance regulator are formed so as to be bendable and raisable.

According to this embodiment, since the resistance regulator is formed so as to be bendable and raisable, for example when the coil terminal is attached to the electromagnetic device, the resistance regulator can be stored into an empty space of the electromagnetic device. This can prevent an increase in size of the electromagnetic device due to the shape of the resistance regulator. Further, even after the coil has been wound around the spool of the electromagnetic device, the connectors and the resistance regulator can be bent and raised simultaneously. It is thus possible to prevent interference of the connectors and the resistance regulator at the time of winging the coil. This can result in facilitating manufacturing of the electromagnetic device.

As one embodiment of the present invention, it may be configured such that the terminal portions, the coupler, and the connectors are disposed along the same plane, and the resistance regulator is disposed so as to project in a direction orthogonal to the plane where the terminal portions, the coupler, and the connectors are disposed.

According to this embodiment, the value of resistance between the terminal portions can be set to a desired value.

As one embodiment of the present invention, it may be configured such that the terminal portions, the coupler, and the connectors are integrally formed by the same resistive material.

According to this embodiment, since the value of resistance between the terminal portions can be set in a wider range, it is possible to increase the range of design of the coil terminal.

As one embodiment of the present invention, it may be configured such that a conductive material covers the terminal portions, the connectors, and part or whole of the surface of the coupler in a path from the terminal portions to the connectors.

According to this embodiment, since the value of resistance between the terminal portions can be set in a wider range, it is possible to increase the range of design of the coil terminal.

The electromagnetic relay of the present invention is provided with the coil terminal.

According to the electromagnetic relay of the present invention, incorporating the coil terminals can facilitate size reduction.

MODE FOR CARRYING OUT THE INVENTION

Figure 1:
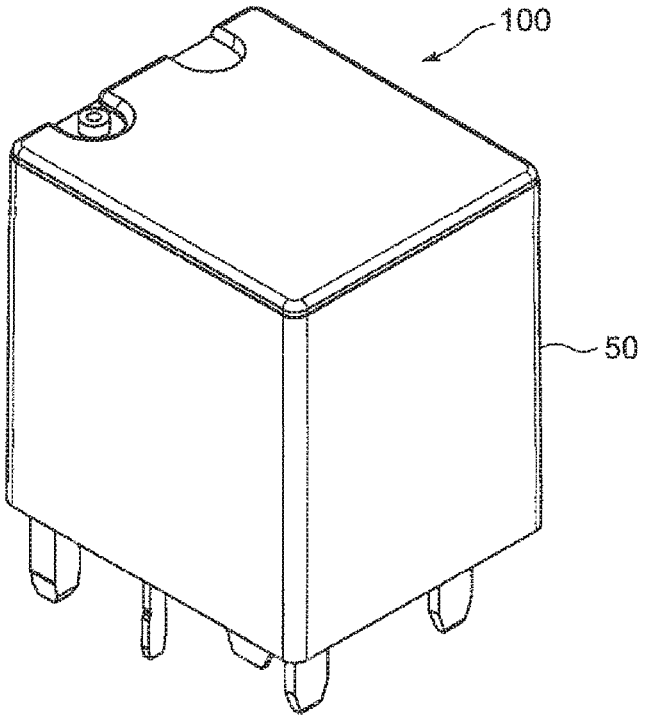
FIG. 1 is a perspective view illustrating an electromagnetic relay provided with a coil terminal of a first embodiment of the present invention.

Hereinafter, an embodiment of the present invention will be described with reference to the accompanying drawings. In the following description, in describing configurations represented in the drawings, terms showing directions such as "up", "down", "left", and "right", and other terms including those, will be used. The purpose for using those terms is to facilitate understanding of the embodiment through the drawings. Accordingly, those terms do not necessarily show directions used at the time of actually using the embodiment of the present invention. A technical scope of the invention recited in the claims shall not be restrictively interpreted by using those terms.

Figure 2:
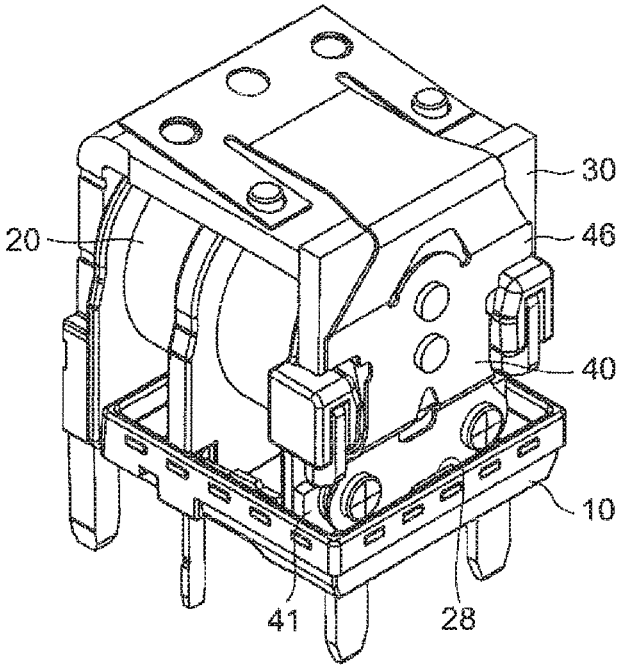
FIG. 2 is a perspective view illustrating a state of the electromagnetic relay of FIG. 1 where a cover has been removed.

As illustrated in FIGS. 1 and 2, an electromagnetic relay 100 provided with a coil terminal of one embodiment of the present invention includes: a base 10; an electric magnet device 20, a movable iron piece 30, and a contact mechanism 40 which are provided on the base 10; and a cover 50 that is mounted on the base 10 so as to cover the electric magnet device 20, the movable iron piece 30, and the contact mechanism 40.

Figure 3:
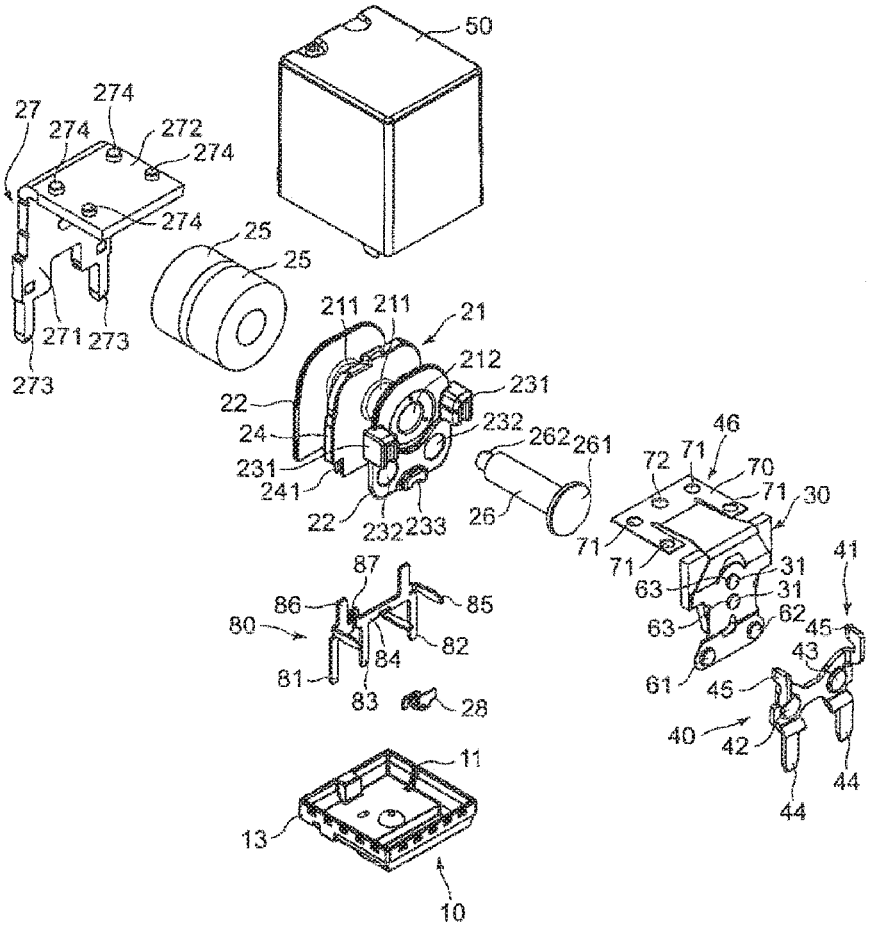
FIG. 3 is an exploded perspective view of the electromagnetic relay of FIG. 1.
Figure 4:
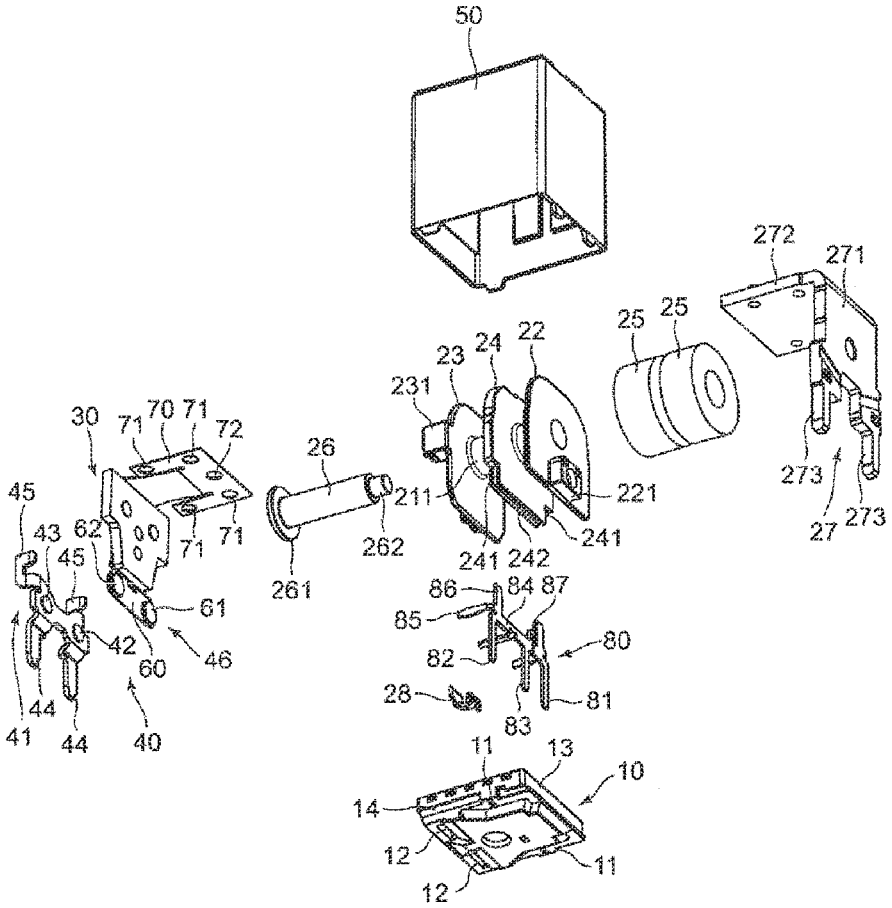
FIG. 4 is an exploded perspective view of the electromagnetic relay of FIG. 1, seen from a direction different from the exploded perspective view of FIG. 3.

The base 10 has a square shape in a top surface view, as illustrated in FIGS. 3 and 4. This base 10 is provided with a coil terminal hole 11 for press-fitting of a coil terminal 80 of the electric magnet device 20 described later, and a fixed terminal hole 12 (illustrated in FIG. 4) for press-fitting of a fixed terminal 44 of the contact mechanism 40. As illustrate in FIG. 3, a wall 13 extending upward is provided on a peripheral edge of the base 10. Further, as illustrated in FIG. 4, a step 14 is provided on a periphery of the bottom surface of the base 10.

As illustrated in FIGS. 3 and 4, the electric magnet device 20 is made up of a spool 21, two coils 25 wound around the spool 21, an iron core 26 inserted in the spool 21, a yoke 27 coupled with one end of the iron 26, the coil terminal 80, around which lead wires of the coil 25 are wound, and a position regulator 28 that regulates a moving range of a movable touch piece 46.

The spool 21 is made up of: first and second guard portions 22, 23 respectively provided at both ends; a third guard portion 24 provided between the first and second guard portions 22, 23; and a body 211 that couples the first to third guard portions 22, 23, 24 together.

As illustrated in FIG. 2, the first guard portion 22 is disposed so as to be in contact with the external side surface of the wall 13 of the base 10. As illustrated in FIG. 4, the lower-side center of this first guard portion 22 is provided with a projection 221 for positioning of the yoke 27.

The second guard portion 23 is disposed substantially parallel to the internal side surface of the wall 13 of the base 10 at a predetermined interval. Both sides of this second guard portion 23 are provided with attachments 231 for attachment of a fixed contact terminal 41 described later. Further, both lower corner portions of the second guard portion 23 are provided with recesses 232 for positioning of the first and second fixed contacts 42, 43, and the lower central portion of the second guard portion 23 is provided with an attachment 233 for attachment of the position regulator 28.

Figure 7:
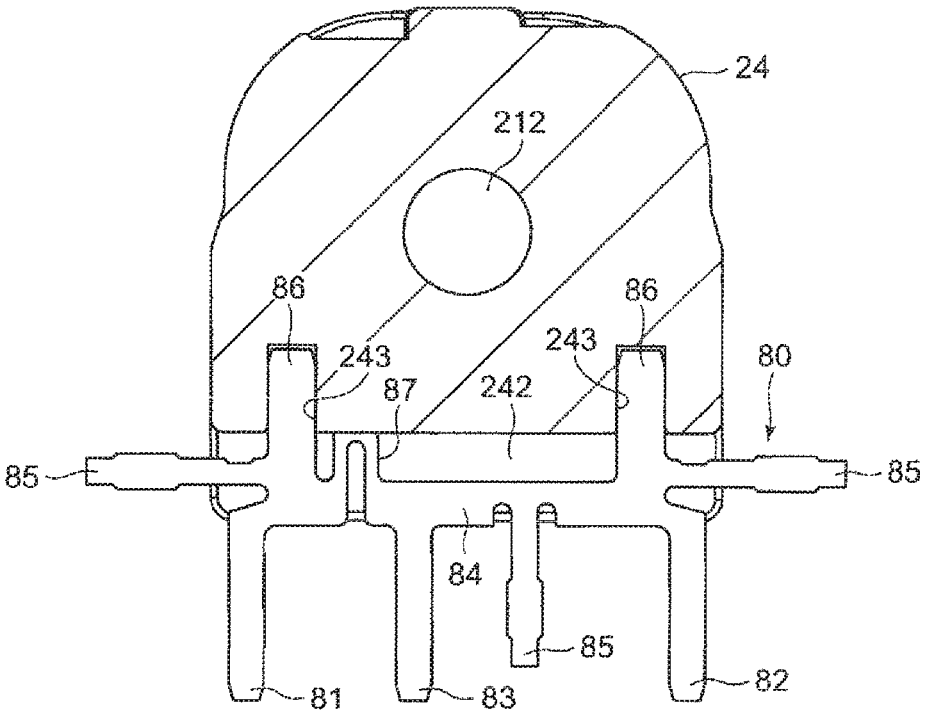
FIG. 7 is a sectional view along line VI-VI of FIG. 6.
Figure 8:
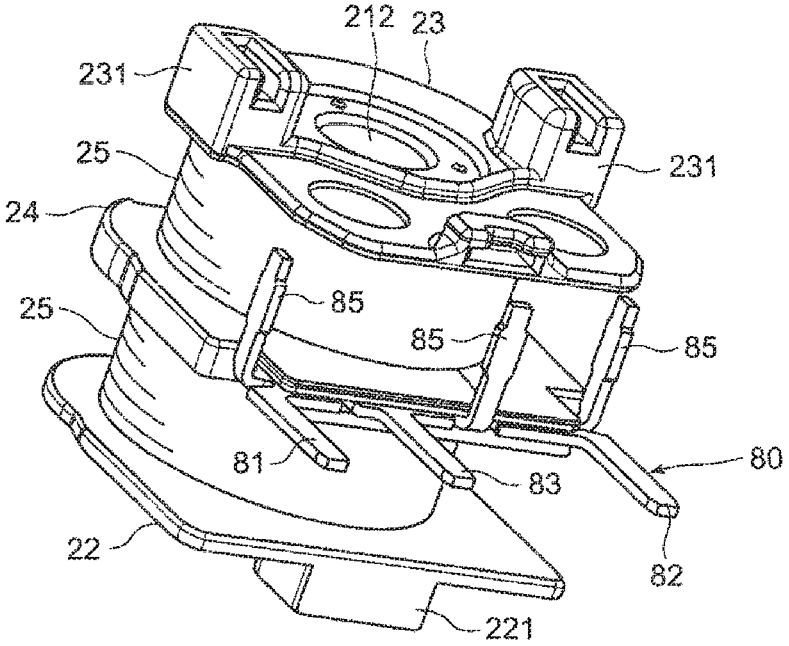
FIG. 8 is a perspective view illustrating a state of the electromagnetic device of FIG. 6 where the coil has been wound.

The third guard portion 24 is disposed substantially parallel to the first guard portion 22 and the second guard portion 23. Notches 241 are provided at both lower ends of the third guard portion 24. As illustrated in FIG. 4, the bottom surface of the third guard portion 24 is provided with a terminal groove 242 for attachment of the coil terminal 80. Further, as illustrated in FIG. 7, the terminal groove 242 is provided with press-fit grooves 243 for press-fitting of the coil terminal 80. The body 211 is provided in substantial centers of the first to third guard portions 22, 23, 24, and has a through hole 212 for insertion of the iron core 26.

The coil 25 is wound around the body 211 between the first guard portion 22 and the third guard portion 24 of the spool 21, and the body 211 between the second guard portion 23 and the third guard portion 24.

The iron core 26 has a substantially cylindrical shape and is formed by a magnetic material. Both ends of the iron core 26 are provided respectively with a magnetic pole portion 261 for attraction of the movable iron piece 30, and a caulking portion 262 for caulking and fixing to the yoke 27.

The yoke 27 is a substantially L-shaped platy body made of a magnetic material, and made up of a vertical portion 271 and a horizontal portion 272. Terminal portions 273 are provided on both lower ends of the vertical portion 271. In this yoke 27, the vertical portion 271 is in contact with the first guard portion 22 of the spool 21, and a projection 221 of the first guard portion 22 is disposed between the terminal portions 273. Further, each corner portion of the horizontal portion 272 is provided with a protrusion 274 for caulking and fixing of the movable touch piece 46.

Figure 5:
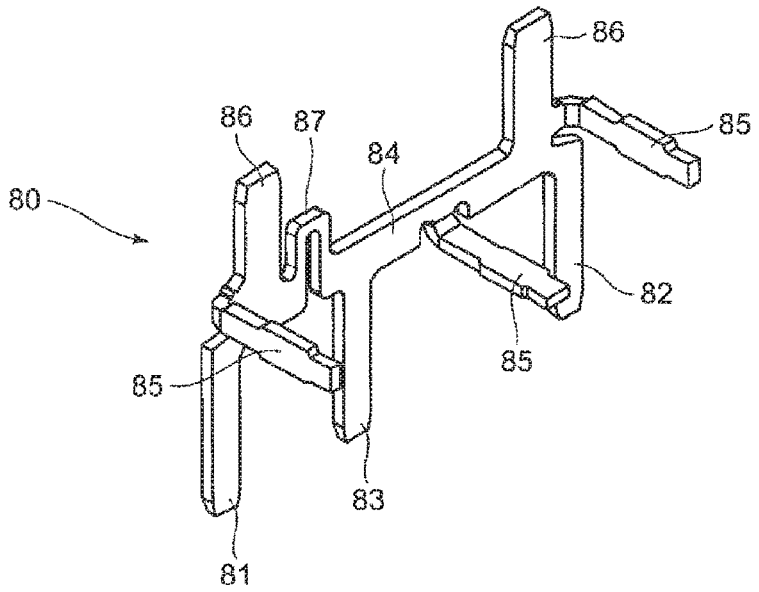
FIG. 5 is a perspective view illustrating a coil terminal of the first embodiment.

As illustrated in FIG. 5, the coil terminal 80 is made up of: first to third terminal portions 81, 82, 83; connectors 85; press-fit portions 86; and a coupler 84 for coupling the first to third terminal portions 81, 82, 83, the connectors 85, and the press-fit portions 86. The first to third terminal portions 81, 82, 83, the coupler 84, the connectors 85, and the press-fit portion 86 are integrally formed by a resistive material made of an alloy of nickel, chromium, manganese or the like.

The first to third terminal portions 81, 82, 83 are disposed at intervals and project parallel to one another from the coupler 84 in the same direction. Note that the first and third terminal portions 81, 83 constitute a set coil terminal, and the second and third terminal portions 82, 83 constitute a reset coil terminal.

The connectors 85 are disposed at both ends of the coupler 84 and between the second and third terminal portions 82, 83, and bent and raised in a direction substantially orthogonal to the first to third terminal portions 81, 82, 83. Each of the connectors 85 is connected with a lead wire of the coil 25.

The press-fit portions 86 are disposed at both ends of an upper side of the coupler 84, and project from the coupler 84 in a direction opposite to the first to third terminal portions 81, 82, 83. Note that as illustrated in FIG. 7, the press-fit portions 86 are portions to be press-fit into the press-fit grooves 243 in the third guard portion 24 of the spool 21.

Further, a resistance regulator 87 is provided in the coupler 84 between the first and third terminal portions 81, 83. This resistance regulator 87 projects in the same direction as the projecting directions of the press-fit portions 86, and is formed by bending part of the coupler 84. By providing the resistance regulator 87, the distance between the first and third terminal portions 81, 83 is made long, so that a value of resistance between the first and third terminal portions 81, 83 is made high as compared with the case of not providing the resistance regulator 87.

As illustrated in FIGS. 3 and 4, the movable iron piece 30 is a platy body made of a magnetic member, and has a protrusion 31 for caulking and fixing of the movable touch piece 46.

As illustrated in FIGS. 3 and 4, the contact mechanism 40 is made up of a fixed contact terminal 41 and a movable touch piece 46.

The fixed contact terminal 41 is a rectangular platy body having conductivity. The fixed contact terminal 41 includes the first and second fixed contacts 42, 43 which are respectively caulked and fixed to both longitudinal ends, and includes the fixed terminals 44 respectively corresponding to the first and second fixed contacts 42, 43. Further, the longitudinal outer sides of the first and second fixed contacts 42, 43 are provided with press-fit portions 45 for press-fitting of the fixed contact terminal 41 to the attachment 231 of the second guard portion 23.

The movable touch piece 46 is a substantially L-shaped platy body having elasticity and conductivity, and made up of a first planner portion 60 and a second planner portion 70. First and second movable contacts 61, 62 are provided at free end of the first planner portion 60.

The first movable contact 61 is disposed facing the first fixed contact 42 contactably to or separably from the first fixed contact 42. The second movable contact 62 is disposed facing the second fixed contact 43 contactably to or separably from the second fixed contact 43. Further, the first planner portion 60 is provided with a through hole 63 for caulking and fixing of the movable touch piece 46 to the movable iron piece 30.

Each corner portion of the second planner portion 70 is provided with a first through hole 71 for caulking and fixing of the movable touch piece 46 to the yoke 27 of the electric magnet device 20. Moreover, the substantially center of the free end of the second planner portion 70 is provided with a second through hole 72 for provisional holding of the movable touch piece 46 at the time when the movable touch piece 46 is caulked and fixed to the yoke 27.

As illustrated in FIGS. 3 and 4, the cover 50 has a box shape having one open surface and is mounted on the base 10 so as to cover the electric magnet device 20, the movable iron piece 30, and the contact mechanism 40. In the state of the cover 50 mounted on the base 10, the inner peripheral surface of the cover 50 and the step 14 (illustrated in FIG. 4) of the base 10 form a groove portion (not illustrated). A sealing member is injected into this groove portion to seal a gap formed between the base 10 and the cover 50.

Next, the step of attaching the coil terminal 80 to the spool 21 will be described.

Figure 6:
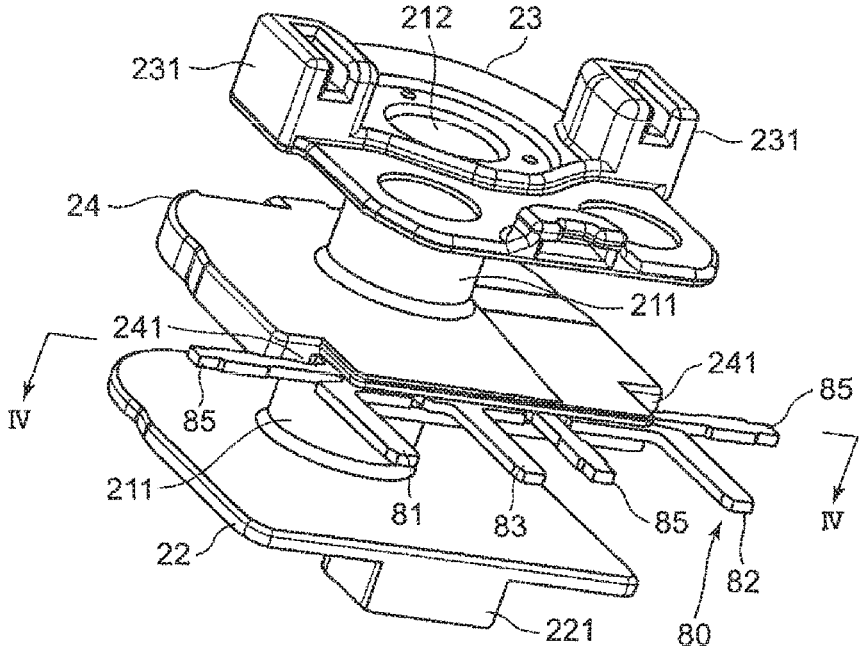
FIG. 6 is a perspective view illustrating a state of the electromagnetic device of FIG. 1 in the electromagnetic relay, before the coil is wound.

As illustrated in FIGS. 6, 7, the press-fit portions 86 of the coil terminal 80 are inserted into the terminal groove 242 in the third guard portion 24 of the spool 21 to press-fit the press-fit portion 86 into the press-fit grooves 243.

Next, the coil 25 is wound around the body 211 of the spool 21. Then, the connectors 85 at both ends of the coupler 84, which are located in the notches 241, and the connector 85 between the second and third terminal portions 82, 83, which is located on the bottom surface of the third guard portion 24, are bent and raised toward the second guard portion 23. At this time, the connectors 85 at both ends of the coupler 84 are bent and raised so as to extend parallel to the wall 13 of the base 10 at the time of mounting the electric magnet device 20 on the base 10. Further, the connector 85 between the second and third terminal portions 82, 83 is bent and raised so as to extend parallel to the bottom surface of the base 10.

Note that in the coil terminal 80 of the first embodiment, in a state before the connectors 85 is bent and raised, the first to third terminal portions 81, 82, 83, the coupler 84, the connectors 85, the press-fit portion 86, and the resistance regulator 87 are disposed along the same plane, as illustrated in FIGS. 6 and 7. Thus, after the coil 25 has been wound around the body 211 of the spool 21, the coil terminal 80 may be press-fit into the spool 21.

Next, the operation of the electromagnetic relay 100 will be described.

In the electromagnetic relay 100 before a current is supplied to the coil 25 via the coil terminal 80 to excite the electric magnet device 20, as illustrated in FIG. 2, the movable touch piece 46 is biased by its own spring force in a direction separated from the fixed contact terminal 41, and is in contact with the position regulator 28. At this time, the first and second movable contacts 61, 62 and the first and second fixed contacts 42, 43 are held in a separate state, and not in contact with each other.

When a current is supplied to the coil 25 to excite the electric magnet device 20, the iron core 26 is magnetized, and the movable iron piece 30 is attracted to the magnetic pole portion 261. With this, the movable touch piece 46 moves toward the fixed contact terminal 41 along with the movable iron piece 30, whereby the first movable contact 61 and the first fixed contact 42 come into contact with each other, and the second movable contact 62 and the second fixed contact 43 come into contact with each other.

Thereafter, when the current supply to the coil 25 is stopped, the attractive force by the magnetic pole portion 261 of the iron core 26 disappears. With this, the movable touch piece 46 moves by its own spring force in a direction separated from the fixed contact terminal 41, whereby the first movable contact 61 and the first fixed contact 42 are separated from each other, and the second movable contact 62 and the second fixed contact 43 are separated from each other. The movable touch piece 46 then moves until coming into contact with the position regulator 28.

Since the coil terminal 80 having the above configuration is provided with the resistance regulator 87 formed by bending at least part of the coupler 84 for coupling the first to third terminal portions 81, 82, 83, changing the shape of the resistance regulator 87 can adjust resistance among the first to third terminal portions 81, 82, 83. This enables absorption of a serge voltage without provision of a ready-made resistor, for example, and hence there are no restrictions on the shape and placement which would occur at the time of mounting the ready-made resistor or the like. It is thereby possible to enhance a design freedom of the coil terminal 80, and facilitate reduction in size of the electromagnetic relay 100.

Further, since the coupler 84 is formed of the resistive material, by appropriately selecting the resistive material in addition to the shape of the resistance regulator 87, the resistance among the first to third terminal portions 81, 82, 83 can be changed to a desired value.

In the coil terminal 80 having the above configuration, in a state before the connectors 85 is bent and raised, the first to third terminal portions 81, 82, 83, the coupler 84, the connectors 85, the press-fit portion 86, and the resistance regulator 87 are disposed along the same plane as illustrated in FIGS. 6 and 7. This can facilitate formation of the coil terminal 80 by press working or the like.

Other Embodiments

Figure 9:
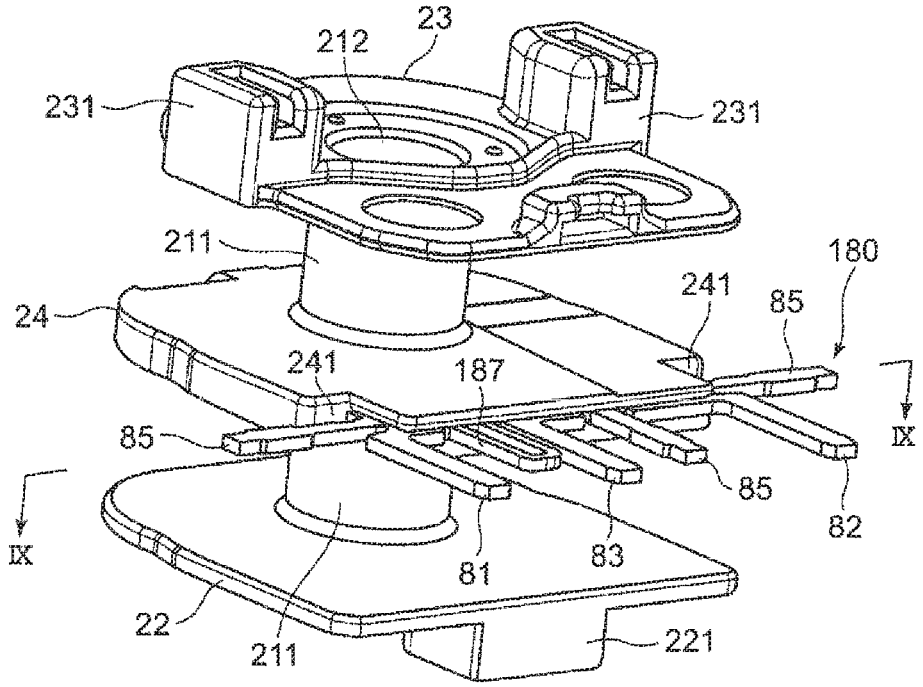
FIG. 9 is a perspective view illustrating a state of the electromagnetic device in the electromagnetic relay provided with a coil terminal of a second embodiment of the present invention, before the coil is wound.
Figure 10:
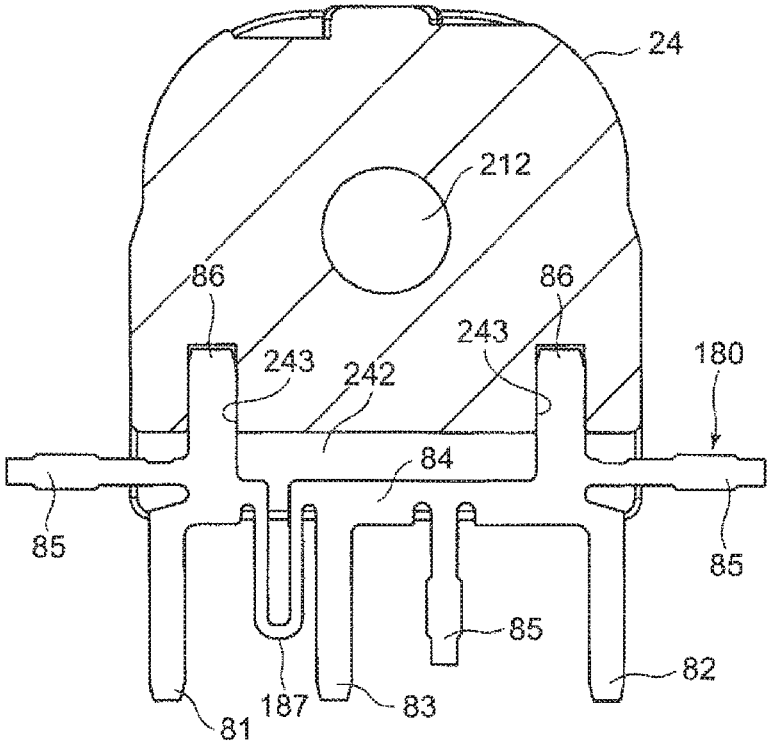
FIG. 10 is a sectional view along line IX-IX of FIG. 8.
Figure 11:
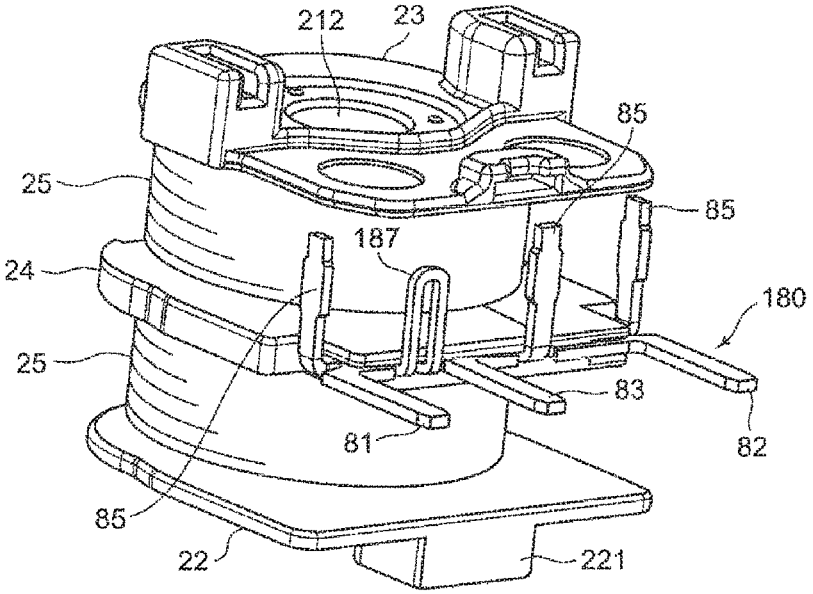
FIG. 11 is a perspective view illustrating a state of the electromagnetic device of FIG. 8 where the coil has been wound.

The coil terminal 80 is not restricted to the first embodiment. For example, as in a coil terminal 180 of a second embodiment illustrated in FIGS. 9 to 11, a resistance regulator 187 may be projected in the same direction as the projecting directions of the first to third terminal portions 81, 82, 83, and the projected portion may be bent and raised together with the connectors 85. By projecting the resistance regulator 187 in the same direction as the projecting directions of the first to third terminal portions 81, 82, 83, for example when the coil terminal 180 is attached to the electromagnetic device, the resistance regulator 187 can be stored into an empty space of the electromagnetic device. This can prevent an increase in size of the electromagnetic device due to the shape of the resistance regulator 187 Further, even after the coil has been wound around the spool of the electromagnetic device, the connectors 85 and the resistance regulator 187 can be bent and raised simultaneously. It is thus possible to prevent interference of the connectors 85 and the resistance regulator 187 at the time of winging the coil 25. This can result in facilitating manufacturing of the electromagnetic device.

Figure 12:
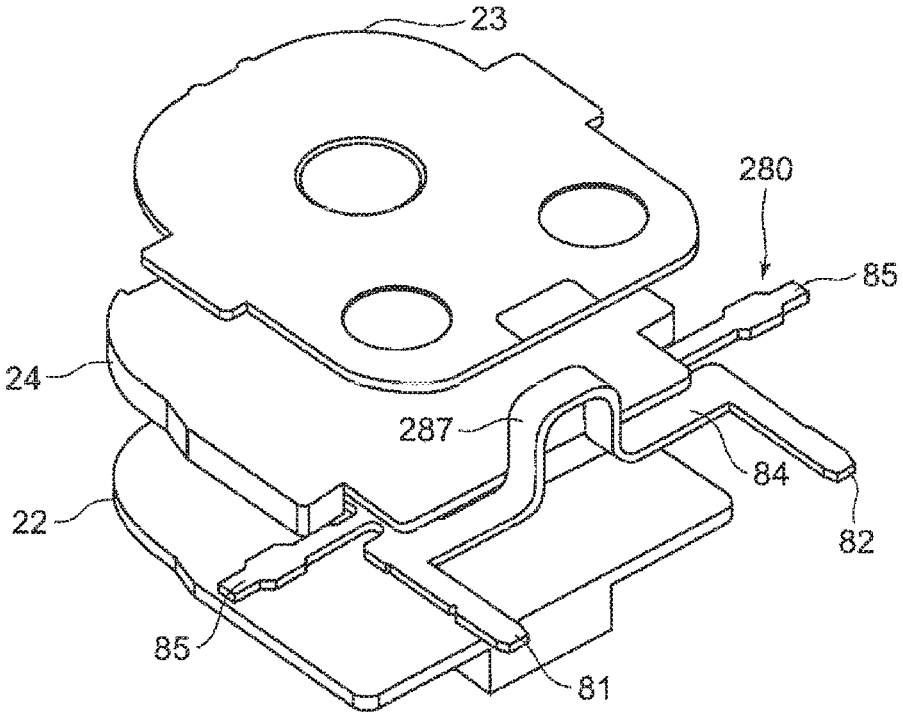
FIG. 12 is a perspective view illustrating a state of the electromagnetic device in the electromagnetic relay provided with a coil terminal of a third embodiment of the present invention, before the coil is wound.

Further, as in a coil terminal 280 of a third embodiment illustrated in FIG. 12, the number of the terminal portions 81, 82 and the number of connectors 85 may simply be at least two each. That is, the coil may have either one winding or two windings. A resistance regulator 287 may be disposed so as to extend in a direction orthogonal to a plane where the first and second terminal portions 81, 82, the coupler 84, and the connectors 85 are disposed. In the third embodiment, the resistance regulator 287 projects in a direction substantially orthogonal to the plane where the first and second terminal portions 81, 82, the coupler 84, and the connectors 85 are disposed.

Figure 13:
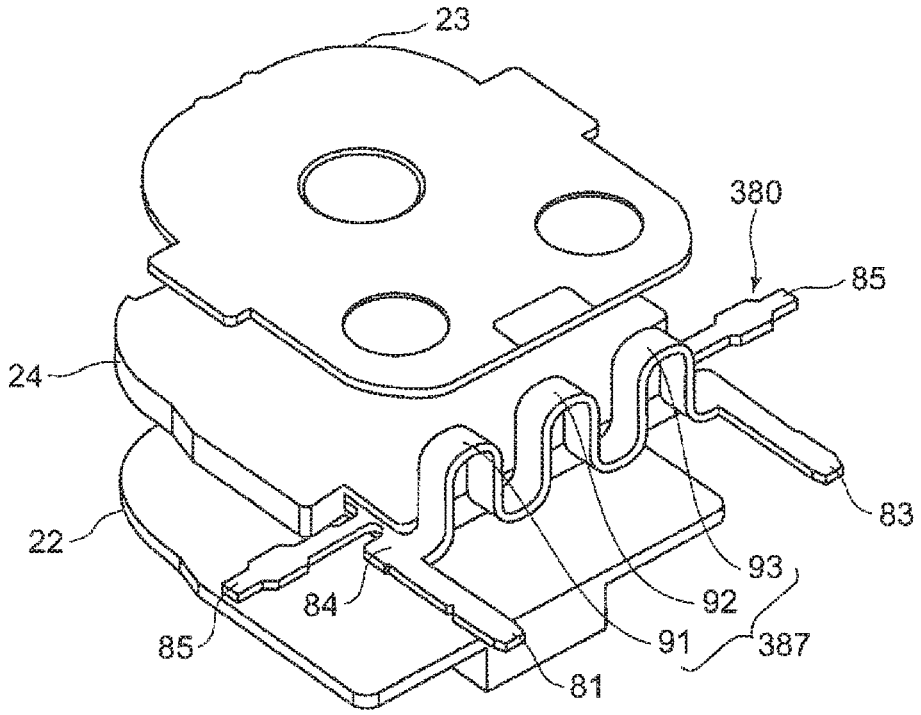
FIG. 13 is a perspective view illustrating a state of the electromagnetic device in the electromagnetic relay provided with a coil terminal of a fourth embodiment of the present invention, before the coil is wound.

Moreover, as in a coil terminal 380 of a fourth embodiment illustrated in FIG. 13, a plurality of projections 91, 92, 93 may constitute a resistance regulator 387.

As thus described, for the shape of the resistance regulator, a freely selected shape can be employed, and the resistance regulator can be formed by a freely selected resistive material. Hence it is possible to set a value of resistance between the terminal portions to a desired value, and thereby to increase the range of design of the coil terminal.

The coil terminal 80 is not restricted to the case where the first to third terminal portions 81, 82, 83, the coupler 84, the connectors 85, and the press-fit portion 86 are integrally formed by the same resistive material. At least the coupler may simply be formed by the resistive material. The first to third terminal portions, the connectors, and the press-fit portions may be separately formed by materials other than the resistive material.

The connectors 85 are not restricted to the case of being connected to the first to third terminal portions 81, 82, 83 via the coupler 84. For example, the connectors may be directly coupled to the first to third terminal portions.

A conductive material may cover the first to third terminal portions 81, 82, 83, the connectors 85, and the surface of the coupler 84 in a path from the first to third terminal portions 81, 82, 83 to the connectors 85. For example, copper plating processing is performed on the first to third terminal portions 81, 82, 83, the connectors 85, and part or whole of the surface of the coupler 84 in a path from the first to third terminal portions 81, 82, 83 to the connectors 85, thereby enabling reduction in electric resistance of a conductive path from the first to third terminal portions 81, 82, 83 to the connectors 85.

The coil terminal 80 can perform surface treatment, such as plating or coating, as required.

The coil terminals 80, 180, 280, 380 of the first to fourth embodiments are applicable to the electromagnetic relay.

Naturally, the constituents described in the above embodiments may be appropriately combined, or may be appropriately selected, replaced, or deleted.

INDUSTRIAL APPLICABILITY

The coil terminal of the present invention is not restrictively applicable to an electromagnetic relay, but is applicable to other electromagnetic equipment.

DESCRIPTION OF SYMBOLS

10 base
11 coil terminal hole
12 fixed terminal hole
13 wall
14 step
20 electromagnetic device
21 spool
211 body
212 through hole
22 first guard portion
221 projection
23 second guard portion
231 attachment
232 recess
233 attachment
24 third guard portion
241 notch
25 coil
26 iron core
261 magnetic pole portion
262 caulking portion
27 yoke
271 vertical portion
272 horizontal portion
273 terminal portion
274 protrusion
28 position regulation member
30 movable iron piece
31 protrusion
40 contact mechanism
fixed contact terminal
42 first fixed contact
43 second fixed contact

44 fixed terminal
45 press-fit portion
46 movable touch piece
50 cover
60 first planar portion
61 first movable contact
62 second movable contact
63 through hole
70 second planar portion
71 first through hole
72 second through hole
80, 180, 280, 380 coil terminal
81 first terminal portion
82 second terminal portion
83 third terminal portion
84 coupler
85 connector
86 press-fit portion
87, 187, 287, 387 resistance regulator
91, 92, 93 projection
100 electromagnetic relay

The invention claimed is:

1. A coil terminal comprising:

at least two terminal portions configured to supply a current to a coil;

a coupler configured to couple at least the terminal portions; and at least two connectors provided in the terminal portions or the coupler and connected with a lead wire of the coil, wherein the coupler is formed by a resistive material, and includes a resistance regulator formed by bending at least part of the coupler.

2. The coil terminal according to claim 1, wherein the terminal portions, the coupler, the connectors, and the resistance regulator are disposed along the same plane, the terminal portions and the resistance regulator project in the same direction, and the connectors and the resistance regulator are formed so as to be bendable and raisable.

3. The coil terminal according to claim 1, wherein the terminal portions, the coupler, and the connectors are disposed along the same plane, and the resistance regulator is disposed so as to extend in a direction orthogonal to the plane where the terminal portions, the coupler, and the connectors are disposed.

4. The coil terminal according to claim 1, wherein the terminal portions, the coupler, and the connectors are integrally formed by the same resistive material.

5. The coil terminal according to claim 4, wherein a conductive material covers the terminal portions, the connectors, and part or whole of a surface of the coupler in a path from the terminal portions to the connectors.

6. An electromagnetic relay comprising the coil terminal according to claim 1.

* * * * *